US006869066B2

(12) United States Patent
Koo

(10) Patent No.: US 6,869,066 B2
(45) Date of Patent: Mar. 22, 2005

(54) FILL FILM SHEET FOR COOLING TOWER

(75) Inventor: Jae Byung Koo, Incheon (KR)

(73) Assignee: Kyung In Machinery Co., Ltd., Incheon (KR)

( * ) Notice: Subject to any disclaimer, the term of this patent is extended or adjusted under 35 U.S.C. 154(b) by 0 days.

(21) Appl. No.: 10/318,093

(22) Filed: Dec. 13, 2002

(65) Prior Publication Data

US 2003/0183956 A1 Oct. 2, 2003

(30) Foreign Application Priority Data

Mar. 26, 2002 (KR) ..... 10-2002-0016370

(51) Int. Cl.[7] ..... B01F 3/04
(52) U.S. Cl. ..... 261/112.2; 261/DIG. 11
(58) Field of Search ..... 261/94, 95, 104, 261/112.1, 112.2, 153, 154, DIG. 11, DIG. 72

(56) References Cited

U.S. PATENT DOCUMENTS 3,540,702 A * 11/1970 Uyama ..... 261/112.2
3,733,063 A * 5/1973 Loetel et al. ..... 261/112.2
3,963,810 A * 6/1976 Holmberg et al. ..... 261/112.2
4,361,426 A * 11/1982 Carter et al. ..... 96/299
4,548,766 A 10/1985 Kinney, Jr. et al. ..... 261/112
4,801,410 A 1/1989 Kinney, Jr. et al. ..... 261/112.2
6,260,830 B1 * 7/2001 Harrison et al. ..... 261/112.2
6,460,832 B1 * 10/2002 Mockry et al. ..... 261/112.1

* cited by examiner

*Primary Examiner*—Scott Bushey
(74) *Attorney, Agent, or Firm*—Bacon & Thomas PLLC

(57) ABSTRACT

Disclosed is a fill film sheet for a cooling tower. The fill film sheet has a wave-shaped section which possesses a predetermined radius when measured in an air flowing direction. The fill film sheet is made of a rectangular plate-like material having a zigzagged section which possesses a predetermined width when measured in a water flowing direction. The fill film sheet is formed with zigzagged and chevron-patterned lifts each having a first leg segment which extends toward an air outlet and a second leg segment which extends from the first leg segment toward an air inlet when measured in a downward direction. The first leg segment has a length smaller than that of the second leg segment.

10 Claims, 9 Drawing Sheets

FILL FILM SHEET FOR COOLING TOWER

BACKGROUND OF THE INVENTION

1. Field of the Invention

The present invention relates to a fill film sheet for a cooling tower, and more particularly, to a fill film sheet for a cooling tower which is constructed to increase a contact area between cooling air passing between fill film sheets and cooling water to be cooled, so that the water to be cooled can flow on the fill film sheet while being uniformly distributed.

2. Description of the Related Art

Generally, in a refrigerator, air conditioner, industrial heat exchanger, etc, hot water having undergone heat exchange is cooled by exchanging heat with air in a cooling tower and then used again as cooling water. Cooling towers in which heat exchange between water to be cooled and air is effected primarily fall into two principal categories, that is, those involving countercurrent flow of air and water and those involving cross flow of air and water. In the cross flow type cooling towers, air flow is essentially perpendicular to a path of water travel. Cross flow type cooling towers such as shown in FIG. 1 offer advantages in many instances because of the ability to introduce cooling air across the entire vertical height of a tower casing 101 whereas counter flow type cooling towers require that cooling air be drawn in below a fill film sheet assembly. In the cross flow type cooling tower 100, if water to be cooled is injected through nozzles 102 from upper basins onto fill film sheets 103 arranged in the casing 101, while traveling on the fill film sheets 103, the water is brought into contact with air pulled into between the fill film sheets 103 by virtue of blast force of a blower fan 104, to be thereby cooled. The fill film sheets 103 are uprightly installed in the casing 101 so that the water to be cooled can flow downward thereon.

The fill film sheet 103 is described in U.S. Pat. Nos. 4,548,766 and 4,801,410 issued to Kinny, Jr. et al. As shown in FIGS. 2 and 4, the fill film sheet 103 has chevron-patterned lifts 105. The chevron-patterned lifts 105 are formed on both surfaces of the fill film sheet 103 so that a series of repeatedly zigzagged contours are defined. Ridges 105*a* on one surface of the fill film sheet 103 define valleys 105*b* on the other surface of the fill film sheet 103 and vice versa. As can be readily seen from FIG. 2, the fill film sheet 103 comprises a composite fill film sheet in which an air inlet louver 106 and an eliminator 107 are formed integrally with each other. The chevron-patterned lifts 105 provided to the fill film sheet 103 are formed to be continued in opposite directions in a manner such that each lift 105 has a pair of leg segments 108*a* and 108*b* which cooperate with each other to define the zigzagged contour. As can be readily seen from FIG. 3, the pair of leg segments 108*a* and 108*b* have the same length.

Such fill film sheets 103 can be installed in the casing 101 so that they are positioned at a predetermined separation one from another by spacers 109 having a W or V-shaped configuration. In the fill film sheet 103, since water to be cooled flows while being biased toward the eliminator 107 due to air resistance, the water to be cooled cannot flow to a lower part of the fill film sheet 103 adjacent to the air inlet louver 106. Consequently, loss is caused in an effective cooling area of the fill film sheet 103, as a result of which cooling efficiency of the entire cooling tower is deteriorated. To cope with this problem, the fill film sheet 103 is formed in the shape of a parallelogram in a manner such that the fill film sheet 103 is inclined toward the air inlet louver 106 by about 15°. That is to say, as best shown in FIG. 1, the fill film sheets 103 are installed in the cooling tower 100 to be inclined by about 15° toward the air inlet louver 106.

However, the conventional fill film sheet for a cooling tower, constructed as mentioned above, suffers from defects in that, since the fill film sheet is inclinedly installed in the cooling tower, a volume and a weight of the entire cooling tower cannot but be increased, and therefore, it is difficult to place the cooling tower on the roof of a high-storied building or in a narrow space.

Also, although a contact area between the fill film sheet 103 and the water to be cooled is increased due to the inclined installation of the fill film sheet, since the water to be cooled flows downward along an inclined path, a dwelling time of the water on the fill film sheet is increased. Thus, as circulation of the water is delayed, cooling efficiency of the entire cooling tower is deteriorated.

Further, due to the fact that the fill film sheet made of a plate-like material is formed with the chevron-patterned lifts 105, contact efficiency between the water to be cooled and the air is degraded, and heat exchange efficiency between the water to be cooled and the air is diminished.

SUMMARY OF THE INVENTION

Accordingly, the present invention has been made in an effort to solve the problems occurring in the related art, and an object of the present invention is to provide a fill film sheet for a cooling tower which is constructed to improve a shape of lifts formed on the fill film sheet to allow water to naturally flow on the fill film sheet inclinedly toward an air inlet louver, thereby improving cooling efficiency of the entire cooling tower.

Another object of the present invention is to provide a fill film sheet for a cooling tower which is uprightly installed in the cooling tower to decrease a volume and a weight of the entire cooling tower.

Still another object of the present invention is to provide a fill film sheet for a cooling tower which has an improved strength, does not cause loss or waste of material when being manufactured, and is easily installed in the cooling tower to reduce a manufacturing cost.

Yet still another object of the present invention is to provide a fill film sheet for a cooling tower which is constructed to induce turbulent flow in water to be cooled and air and increase a contact area between the water to be cooled and the air, thereby improving heat exchange efficiency.

In order to achieve the above objects, according to one aspect of the present invention, there is provided a fill film sheet for a cooling tower, wherein the fill film sheet has a wave-shaped section which possesses a predetermined radius when measured in an air flowing direction, is made of a rectangular plate-like material having a zigzagged section which possesses a predetermined width when measured in a water flowing direction, and is formed with zigzagged and chevron-patterned lifts each having a first leg segment which extends toward an air outlet and a second leg segment which extends from the first leg segment toward an air inlet when measured in a downward direction, the first leg segment having a length smaller than that of the second leg segment.

According to another aspect of the present invention, a ratio between lengths of the second and first leg segments is 1:0.75.

According to another aspect of the present invention, each of the chevron-patterned lifts is inclined by about 15° with respect to the air inlet when measured from an upper end toward a lower end of the fill film sheet.

According to another aspect of the present invention, the fill film sheet is defined with a plurality of grooves which extend in a direction perpendicular to a water flowing direction.

According to still another aspect of the present invention, a radius of curvature of the wave-shaped section when measured in the air flowing direction is about 300 mm.

According to yet still another aspect of the present invention, there is provided fill film sheet for a cooling tower, wherein the fill film sheet has a wave-shaped section which possesses a predetermined radius when measured in an air flowing direction, is made of a rectangular plate-like material having a zigzagged section which possesses a predetermined width when measured in a water flowing direction, and is formed with a plurality of chevron-patterned lifts which are inclined toward an air inlet when observed from an upper end toward a lower end of the fill film sheet, each chevron-patterned lift having first and second leg segments which extend in opposite directions, respectively, and have different lengths.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Figure 1:
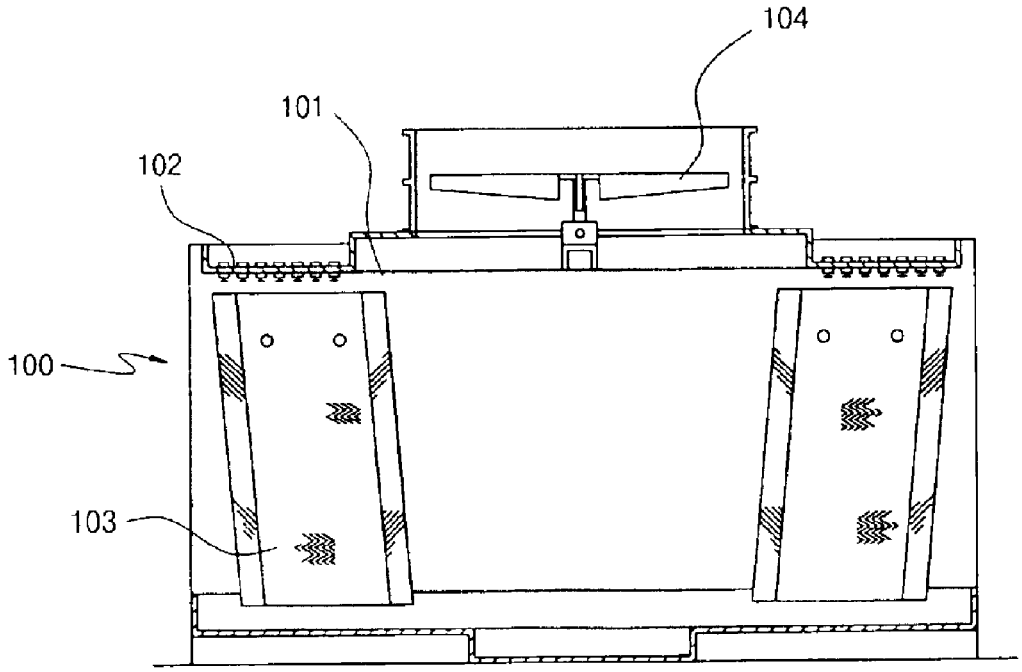
FIG. 1 is a cross-sectional view schematically illustrating the conventional cooling tower using fill film sheets.
Figure 2:
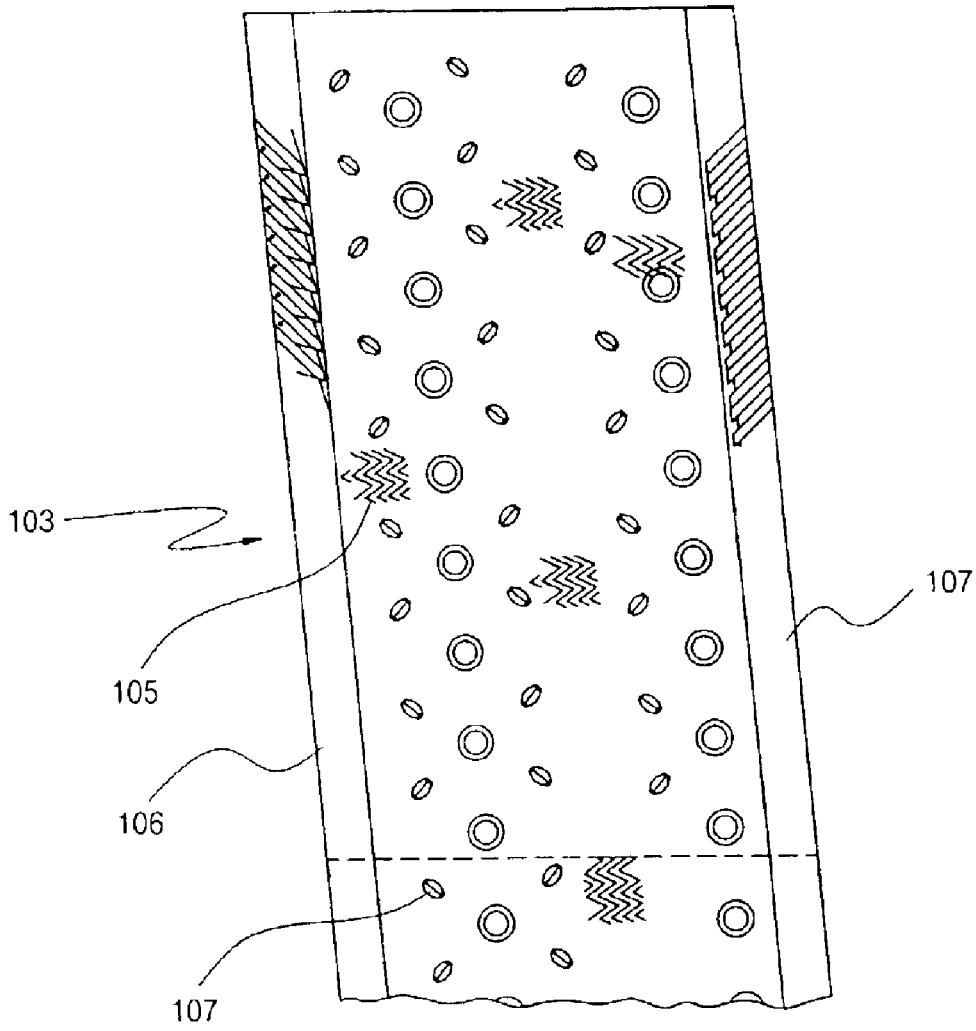
FIG. 2 is a view illustrating a fill film sheet used in the cooling tower shown in FIG. 1.
Figure 3:
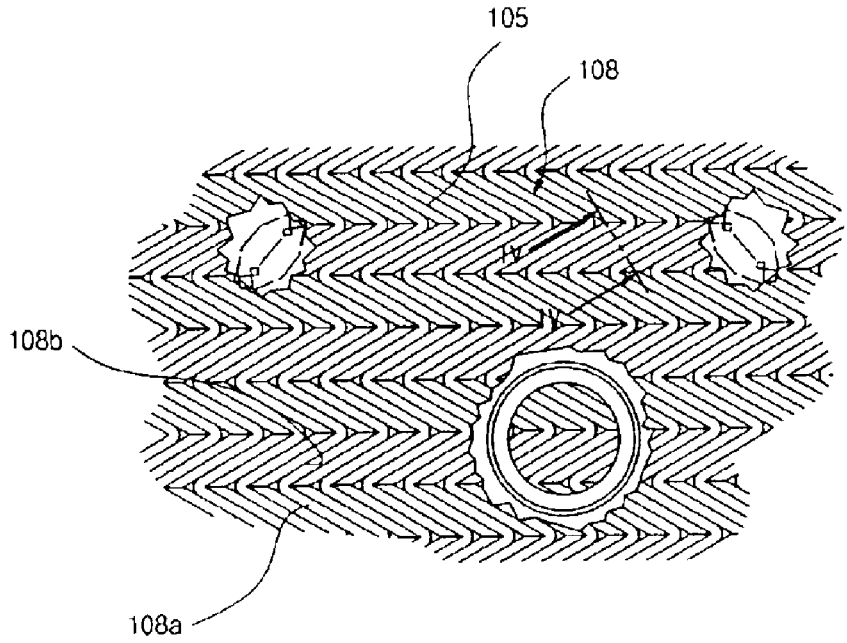
FIG. 3 is a partial enlarged view illustrating chevron-patterned lifts formed on the fill film sheet of FIG. 2.
Figure 4:
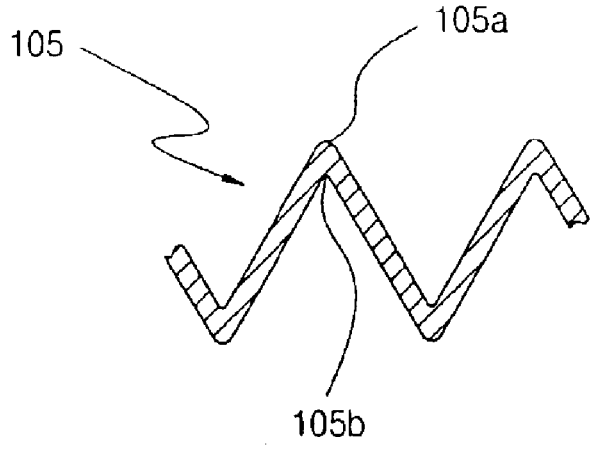
FIG. 4 is a cross-sectional view taken along the line IV—IV of FIG. 3.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 5:
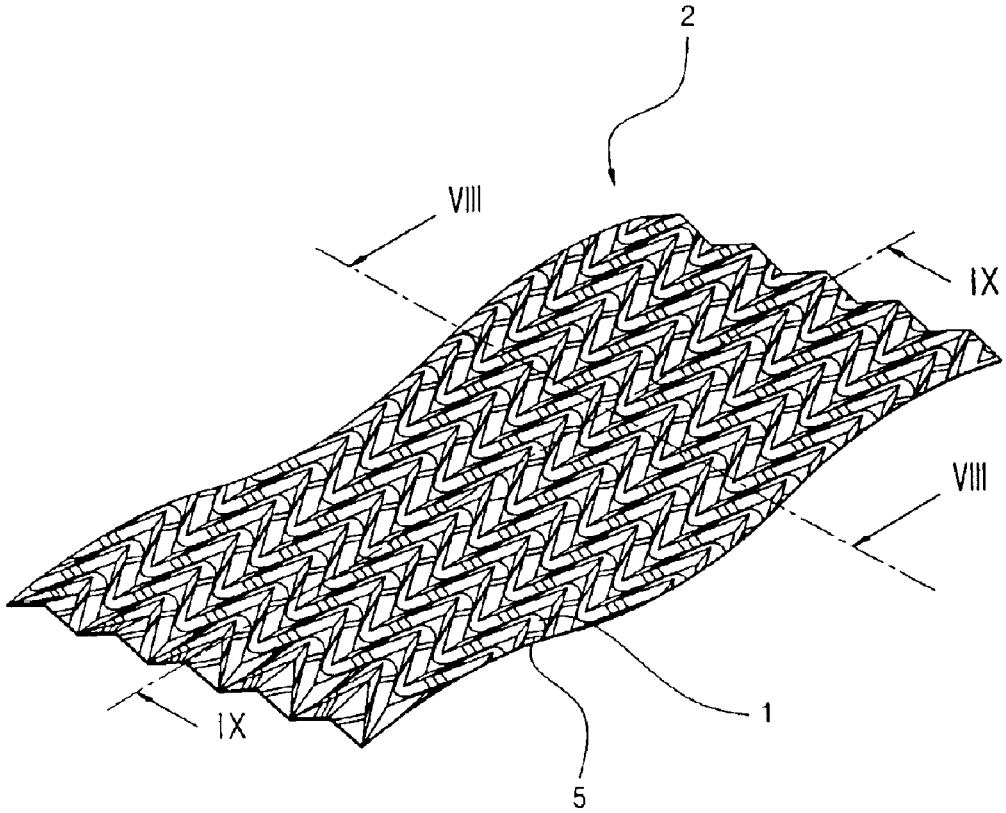
FIG. 5 is a perspective view illustrating a fill film sheet in accordance with an embodiment of the present invention.
Figure 6:
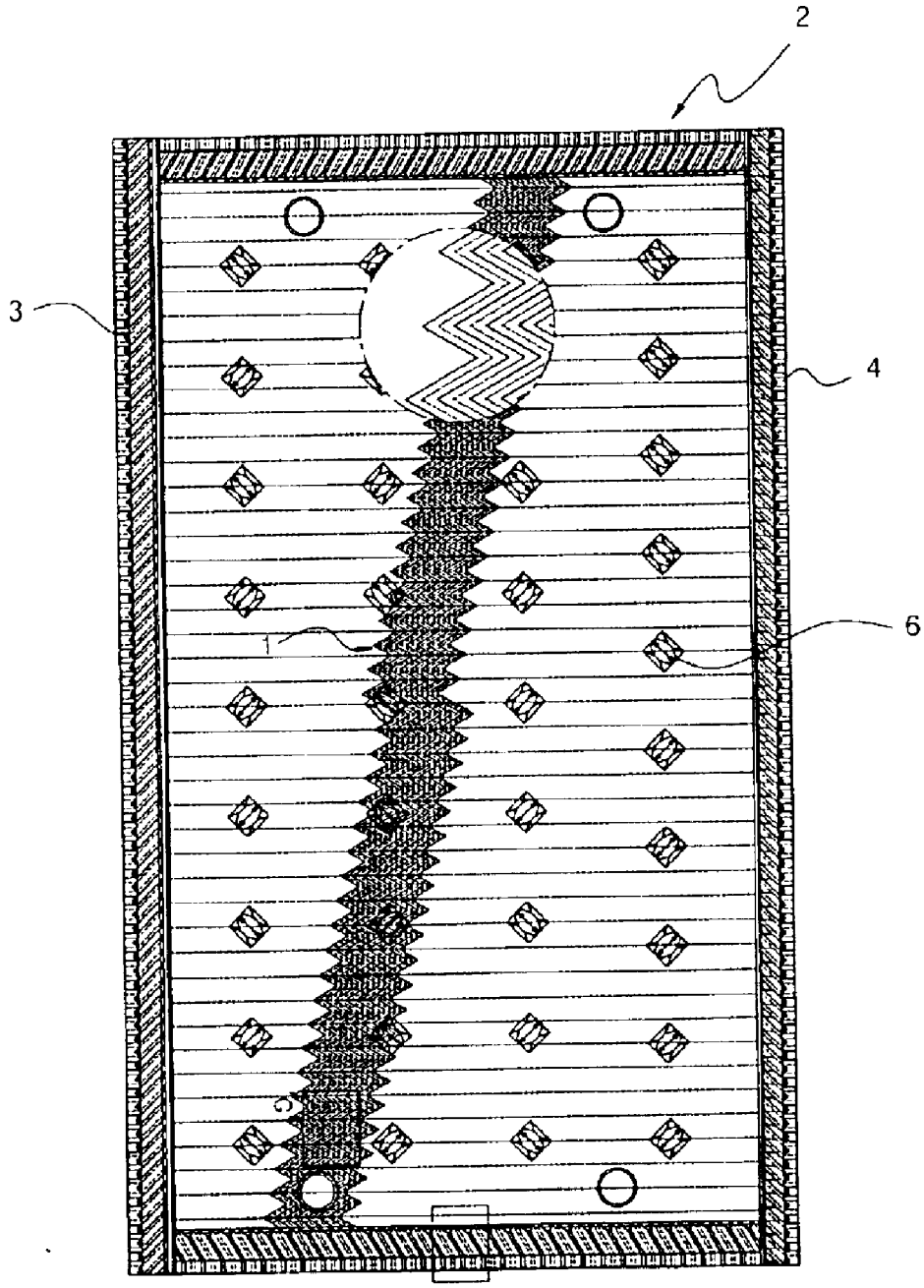
FIG. 6 is a front view of the fill film sheet shown in FIG. 5.
Figure 8:
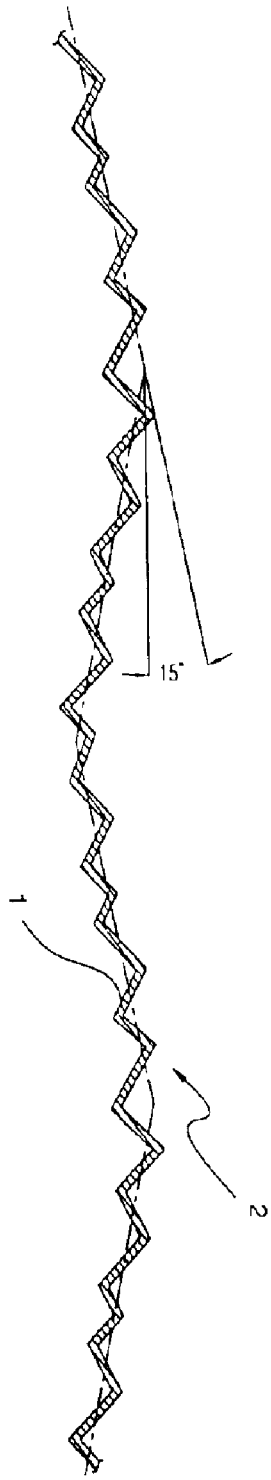
FIG. 8 is a cross-sectional view taken along the line VIII—VIII of FIG. 5.
Figure 9:
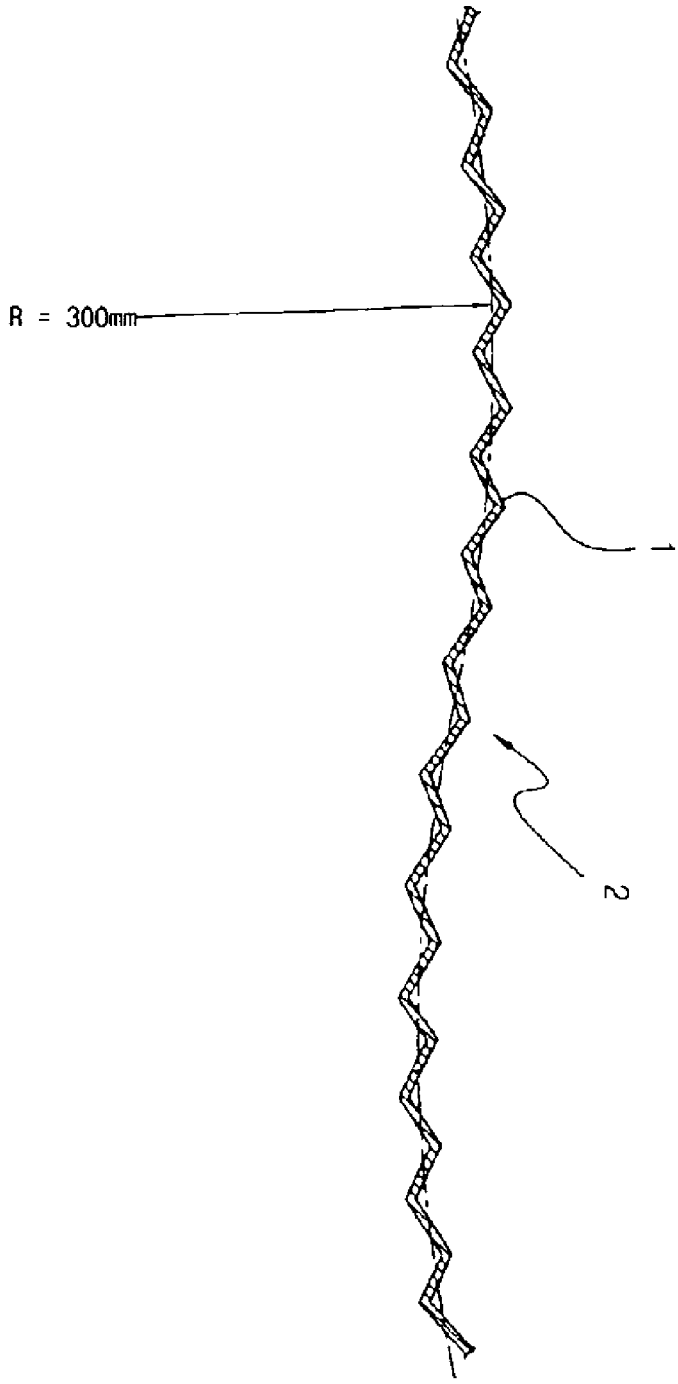
FIG. 9 is a cross-sectional view taken along the line IX—IX of FIG. 5.
Figure 10:
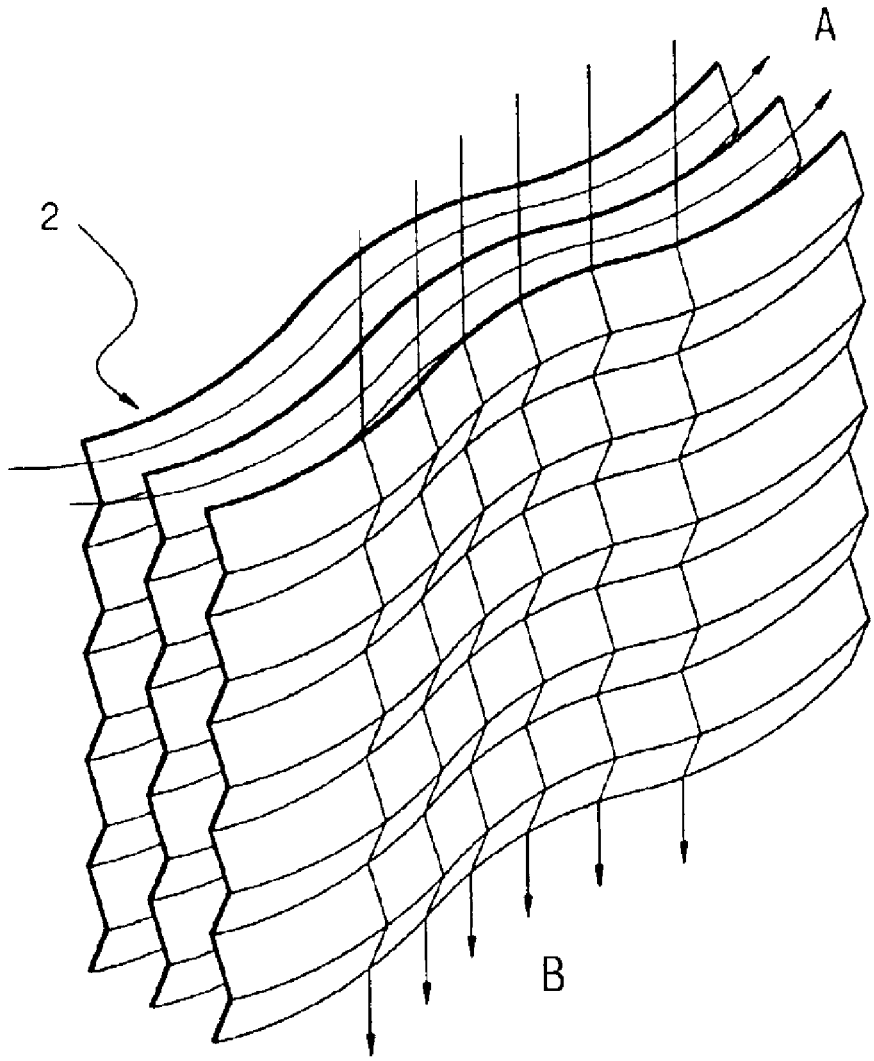
FIG. 10 is a view illustrating flowing directions of cooling water and air passing through filling sheets according to the present invention.

As shown in FIGS. 5, 6 and 10, a fill film sheet 2 for a cooling tower according to the present invention is made of a rectangular plate-like material. The fill film sheet 2 has a predetermined radius of curvature when measured in an air flowing direction A as shown in FIG. 10. For example, as shown in FIG. 9, the fill film sheet 2 has a wave-shaped section which possesses a radius of about 300 mm. Also, as can be readily seen from FIG. 8, the fill film sheet 2 is made of a synthetic resin panel and has a zigzagged contour which is continuously bent by a predetermined angle, for example, 15°, when measured in a water flowing direction B in FIG. 10.

As shown in FIG. 6, the fill film sheet 2 made of the plate-like material having the wave-shaped section and the zigzagged contour in transverse and longitudinal directions, respectively, is formed with a plurality of zigzagged and chevron-patterned lifts 1 and a plurality of spacers 6. As can be readily seen from FIG. 7, each of the chevron-patterned lifts 1 has a first leg segment 1*a* and a second leg segment 1*b*. When observed from an upper end toward a lower end of the fill film sheet 2, the first leg segment 1*a* extends from an air inlet 3 toward an air outlet 4, and the second leg segment 1*b* extends from the first leg segment 1*a* toward the air inlet 3.

Figure 7:
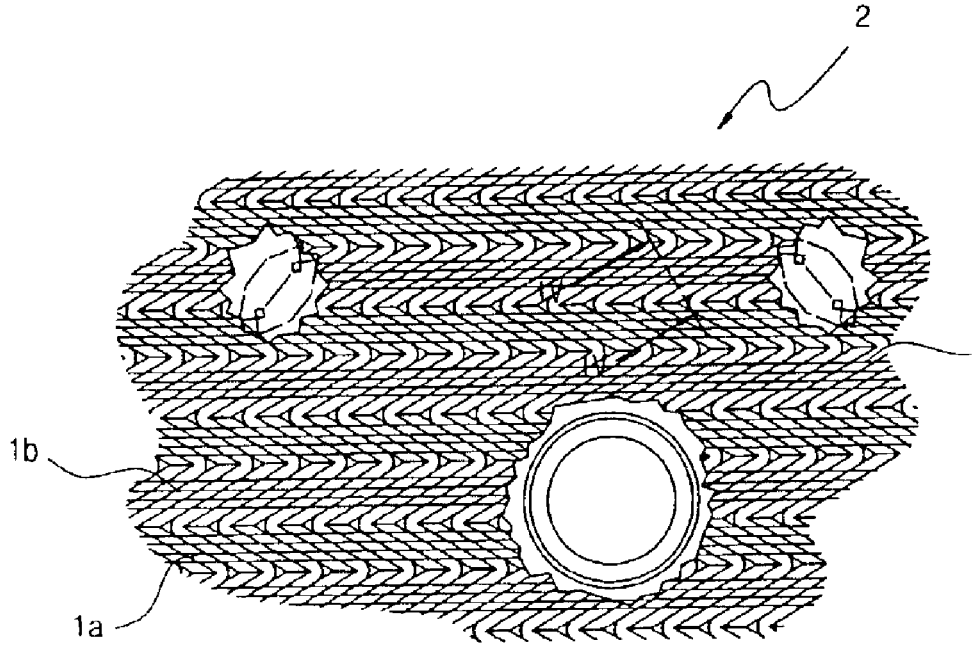
FIG. 7 is a partial enlarged view illustrating chevron-patterned lifts formed on the fill film sheet of FIG. 6.

According to the present invention, in each of the zigzagged chevron-patterned lifts 1, as shown in FIGS. 6 and 7, the first leg segment 1*a* has a length smaller than that of the second leg segment 1*b*. A ratio between lengths of the first and second leg segments 1*a* and 1*b* is set to 0.75:1. On the other hand, each of the first and second leg segments 1*a* and 1*b* which constitute the chevron-patterned lift 1 forms the same angle, for example, of 30°, with respect to a center line 10. Accordingly, the chevron-patterned lifts 1 define the zigzagged contour which is continuously bent by an angle of about 60°.

Meanwhile, due to the fact that, in the chevron-patterned lift 1, the first and second leg segments 1*a* and 1*b* form the same angle with respect to the center line 10 and the first leg segment 1*a* is shorter than the second leg segment 1*b*, as shown in FIG. 6, the zigzagged chevron-patterned lifts 1 are inclined toward the air inlet 3 by about 15° when observed from the upper end toward the lower end of the fill film sheet 2.

As described above, the fill film sheet 2 according to the present invention is made of the plate-like material which has the waved section and the zigzagged contour. The waved section possesses a predetermined curvature when measured in the air flowing direction and the water flowing direction. The zigzagged contour has the predetermined angle. Also, as described above, on the surfaces of the fill film sheet 2, there are formed the chevron-patterned lifts 1 which are continuously defined in a zigzagged manner at an angle of 60° when measured in the air inlet direction.

Further, as described above, when observed from the upper end toward the lower end of the fill film sheet 2, the zigzagged chevron-patterned lifts 1 are, as shown in FIG. 6, inclined by an angle of about 15° toward the air inlet 3. As a consequence, while water flowing along valleys defined between the chevron-patterned lifts 1 is directed toward the air inlet 3, in an actual fact, the water flows downwardly straightforward due to contact resistance of the air introduced into between the fill film sheets 2, as shown in FIG. 10.

In this way, the water to be cooled can flow on the fill film sheet 2 while being uniformly distributed. Therefore, as the water is brought into contact with the entire surface of the fill film sheet 2, cooling efficiency for the water is improved. Meanwhile, according to the present invention, the fill film sheet 2 is defined with a plurality of grooves 5 which extend in a direction perpendicular to the water flowing direction. When the water to be cooled flows on the fill film sheet 2, the grooves 5 function to guide the air introduced toward the fill film sheet 2 and thereby increase a contact area between the air and the water, whereby cooling efficiency for the water is further improved.

In the fill film sheet for a cooling tower according to the present invention, if the hot water is injected through the nozzles to be cooled, the water flows downward on the surfaces of the fill film sheet 2. At this time, as the hot water is brought into contact with the externally introduced air, the hot water exchanges heat with the air to be cooled thereby.

As described above, since turbulent flow is induced in the air traveling between the fill film sheets 2, a contact area and a contact time between the hot water flowing downward on the fill film sheet 2 and the air introduced into the cooling tower are increased, whereby heat exchange efficiency is improved.

Due to the fact that the fill film sheet 2 on which the air and water flow is formed to have a curved surface of a predetermined radius of curvature and a zigzagged contour, a velocity of the water flowing on the fill film sheet 2 is decreased, and a time through which the water is brought into contact with the air passing through the fill film sheets 2 is lengthened. As the contact time between the air and the water is lengthened, thermal energy owned by the water of a high temperature can be transferred to the air of a low temperature through an extended period of time, whereby heat exchange efficiency can be further improved.

Also, due to the presence of the fine grooves 5 defined in the direction which is perpendicular to the water flow on the surfaces of the fill film sheet 2, when the water injected through the injection nozzles flows downward on the fill film sheet 2, flow of the water to be cooled is retarded, and turbulent flow is induced in the water. Therefore, as the water flow is retarded on the fill film sheet 2 and turbulent flow is induced in the water, a contact area and a contact time between the hot water flowing downward on the fill film sheet 2 and the air introduced into the cooling tower are further increased, whereby heat exchange efficiency is still further improved.

Further, because a longitudinal reference surface of the fill film sheet is formed in the shape of a curved surface, air resistance at an inlet through which air is introduced into the cooling tower is decreased to retard water flow, whereby a contact area between the air and water is widened. Also, because a transverse reference surface of the fill film sheet is also formed in the shape of a curved surface, turbulent flow is induced in the air traveling through the fill film sheets. In this way, a contact area between the air and water is enlarged to improve heat exchange efficiency.

Moreover, by the fact that grooves are defined on the surfaces of the fill film sheets to extend in a direction perpendicular to the water flow, turbulent flow is also induced in the water, whereby heat exchange efficiency is improved.

In addition, it is to be noted that a ratio in length between first and second leg segments of a chevron-patterned lift may vary depending upon a flowing velocity of air introduced between the fill film sheets and an injection rate of the water.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A fill film sheet for a cooling tower, wherein the fill film sheet has a wave-shaped section which possesses a predetermined radius when measured in an air flowing direction, is made of a rectangular plate material having a zigzagged section which possesses a predetermined width when measured in a water flowing direction, and is formed with zigzagged and chevron-patterned lifts each having a first leg segment which extends toward an air outlet and a second leg segment which extends from the first leg segment toward an air inlet when measured in a downward direction, the first leg segment having a length smaller than that of the second leg segment.

2. The fill film sheet as set forth in claim 1, wherein a ratio between lengths of the second and first leg segments is 1:0.75.

3. The fill film sheet as set forth in claim 1, wherein each of the chevron-patterned lifts is inclined by about 15° with respect to the air inlet when measured from an upper end toward a lower end of the fill film sheet.

4. The fill film sheet as set forth in claim 1, wherein the fill film sheet is defined with a plurality of grooves which extend in a direction perpendicular to a water flowing direction.

5. The fill film sheet as set forth in claim 1, wherein a radius of curvature of the wave-shaped section when measured in the air flowing direction is about 300 mm.

6. A fill film sheet for a cooling tower, wherein the fill film sheet has a wave-shaped section which possesses a predetermined radius when measured in an air flowing direction, is made of a rectangular plate material having a zigzagged section which possesses a predetermined width when measured in a water flowing direction, and is formed with a plurality of chevron-patterned lifts which are inclined toward an air inlet when observed from an upper end toward a lower end of the fill film sheet, each chevron-patterned lift having first and second leg segments which extend in opposite directions, respectively, and have different lengths.

7. The fill film sheet as set forth in claim 6, wherein a ratio between lengths of the second and first leg segments is 1:0.75.

8. The fill film sheet as set forth in claim 6, wherein each of the chevron-patterned lifts is inclined by about 15° with respect to the air inlet when measured from an upper end toward a lower end of the fill film sheet.

9. The fill film sheet as set forth in claim 6, wherein the fill film sheet is defined with a plurality of grooves which extend in a direction perpendicular to a water flowing direction.

10. The fill film sheet as set forth in claim 6, wherein a radius of curvature of the wave-shaped section when measured in the air flowing direction is about 300 mm.

* * * * *